US011358819B2

(12) United States Patent
Vaish

(10) Patent No.: US 11,358,819 B2
(45) Date of Patent: Jun. 14, 2022

(54) ROLL OF DISPENSABLE SHEET MATERIAL

(71) Applicant: Mukta Vaish, Stockport (GB)

(72) Inventor: Mukta Vaish, Stockport (GB)

( * ) Notice: Subject to any disclaimer, the term of this patent is extended or adjusted under 35 U.S.C. 154(b) by 0 days.

(21) Appl. No.: 16/970,515

(22) PCT Filed: Feb. 7, 2019

(86) PCT No.: PCT/GB2019/000021

§ 371 (c)(1),
(2) Date: Aug. 17, 2020

(87) PCT Pub. No.: WO2019/158897

PCT Pub. Date: Aug. 22, 2019

(65) Prior Publication Data

US 2020/0377320 A1 Dec. 3, 2020

(30) Foreign Application Priority Data

Feb. 19, 2018 (GB) ..... 1802721
Jun. 6, 2018 (GB) ..... 1809298

(51) Int. Cl.
*B65H 18/28* (2006.01)
*B65H 35/00* (2006.01)
(Continued)

(52) U.S. Cl.
CPC ..... *B65H 18/28* (2013.01); *B65H 35/008* (2013.01); *B65H 35/0026* (2013.01);
(Continued)

(58) Field of Classification Search
None
See application file for complete search history.

(56) References Cited

U.S. PATENT DOCUMENTS 2,472,761 A 6/1949 Reed
2,655,214 A * 10/1953 Van Cleef ..... B65H 35/008 225/65
(Continued)

FOREIGN PATENT DOCUMENTS

CN 102976130 A 3/2013
GB 1143594 A 2/1969
(Continued)

OTHER PUBLICATIONS

JP 2000-238956, Sotodate, "Adhesive tape cutting machine", Sep. 2000, English Translation (Year: 2000).*
(Continued)

*Primary Examiner* — William A. Rivera
(74) *Attorney, Agent, or Firm* — Iandiorio Teska & Coleman, LLP

(57) ABSTRACT

A roll (2) of dispensable sheet material (4), wherein the roll (2) has an inner bore (6), the dispensable sheet material (4) is such that it has a free end (8) which is difficult to find for manual dispensation of the dispensable sheet material (4) from the roll (2), the roll (2) comprises assist means (10) for assisting in the finding of the free end (8) of the dispensable sheet material (4), the assist means (10) comprises a device (12) which extends at least transversely over the width of the roll (2), and the device (12) is movable around the roll (2) such that the device (12) is locatable on the roll (2) at a place to receive an end portion (14) of the dispensable sheet material (4) which contains the free end (8), whereby the device (12) indicates the position of the free end (8) and thereby facilitates the manual dispensation of the dispensable sheet material (4) from the roll (2).

4 Claims, 9 Drawing Sheets

(51) Int. Cl.
*B65H 75/28* (2006.01)
*B65H 75/32* (2006.01)

(52) U.S. Cl.
CPC ..... *B65H 75/285* (2013.01); *B65H 75/32* (2013.01); *B65H 2701/1722* (2013.01); *B65H 2701/1732* (2013.01); *B65H 2701/1752* (2013.01)

(56) References Cited

U.S. PATENT DOCUMENTS 3,138,310 A 6/1964 Blodee
3,140,805 A * 7/1964 Seror ..... B65H 35/0026 225/66
4,405,068 A * 9/1983 Blair ..... B65H 35/0026 225/65
5,788,807 A * 8/1998 Gratz ..... B65H 35/0026 156/577
8,839,838 B2 * 9/2014 Parkhe ..... B65H 35/0013 156/577
2004/0188030 A1 * 9/2004 Chen ..... B65H 35/0026 156/510
2009/0302084 A1 * 12/2009 Liu ..... B65H 35/0086 225/77
2014/0263528 A1 9/2014 Ormerod
2017/0113895 A1 4/2017 Mallahan, III

FOREIGN PATENT DOCUMENTS

JP 2000-296965 * 4/1999
JP 2000-238956 * 9/2000
WO 9702935 A1 1/1997

OTHER PUBLICATIONS

Written Opinion of the International Searching Authority for PCT/GB2019/000021, dated May 31, 2019, six (6) pages.

* cited by examiner

ROLL OF DISPENSABLE SHEET MATERIAL

This invention relates to a roll of dispensable sheet material.

Rolls of dispensable sheet material are well known. With certain types of dispensable sheet material, for example adhesive tape, it is equally well known that the dispensable sheet material is such that it has a free end which is difficult to find for manual dispensation of the dispensable sheet material from the roll. This difficulty in finding the free end of the dispensable sheet material is often a source of much frustration to persons wishing to dispense the dispensable sheet material from the roll.

It is an aim of the present invention to avoid or reduce the above mentioned problem.

Accordingly, the present invention provides a roll of dispensable sheet material, wherein the roll has an inner bore, the dispensable sheet material is such that it has a free end which is difficult to find for manual dispensation of the dispensable sheet material from the roll, the roll comprises assist means for assisting in the finding of the free end of the dispensable sheet material, the assist means comprises a device which extends at least transversely over the width of the roll, and the device is movable around the roll such that the device is locatable on the roll at a place to receive an end portion of the dispensable sheet material which contains the free end, whereby the device indicates the position of the free end and thereby facilitates the manual dispensation of the dispensable sheet material from the roll, and wherein the device is a strip of material which has bent ends for extending at least over sides of the roll in order to hold the device on the roll, and the strip of material is a wire-reinforced strip of material.

The roll is advantageous in that the free end of the dispensable sheet material is easily able to be found, thereby avoiding frustration to a person in trying to find the free end. The roll may be a known roll of dispensable sheet material which has been additionally provided with the assist means. Thus the assist means provides a simple, low cost and easy to use addition to a known roll of dispensable sheet material, and with the addition being one which has the above mentioned substantial advantage of avoiding or reducing user frustration.

In use of the roll of the present invention, the free end of the dispensable sheet material can extend circumferentially beyond the device, or it can terminate on the device. The device may be placed wherever desired by the user in order to indicate the position of the free end of the dispensable sheet material.

The wire-reinforced strip of material may have one or more lengths of reinforcing wire. The wire may be a circular cross-section or it may be wider with flat top and bottom sides. The bent ends may extend just along the sides of the roll, or they may alternatively extend along the sides of the roll and then inwardly towards each other on the inside of the roll.

The wire may be of any suitable material that is easily bent to the required shape and that is able to retain the shape in order to hold the device on the roll. The material will typically be chosen such that the device is easy to move around the roll of dispensable sheet material. The movement may be by simply sliding the device around the roll. Any appropriate type of movement may be employed as may be dictated by the wire-reinforced strip of material and/or the formation of the device and/or the formation of the roll and/or as may be preferred by a user.

The device may be one which includes a slide-facilitating material. Any suitable slide-facilitating material may be employed including, for example, Teflon (Registered Trade Mark).

The roll may include a core on which the dispensable sheet material is wound. The core will usually be made of cardboard, but it may be made of other materials if desired.

The dispensable sheet material may be an adhesive tape. The adhesive tape may be Scotch (Registered Trade Mark) tape. Other types of single-sided adhesive tape may be employed.

Alternatively, the dispensable sheet material may be clingfilm. Any suitable type of clingfilm may be employed.

Alternatively, the dispensable sheet material may be a foil. Any suitable type of foil may be employed. The foil may be an aluminium foil or a foil made of another material.

Alternatively, the dispensable sheet material may be double-sided adhesive tape of the type used on clothes rollers. The clothes rollers are also known as lint rollers, and they are products which are rolled over clothes in order to remove dust, hair, fluff and the like from the clothes.

Embodiments of the invention will now be described solely by way of example and with reference to the accompanying drawings in which.

Figure 1:
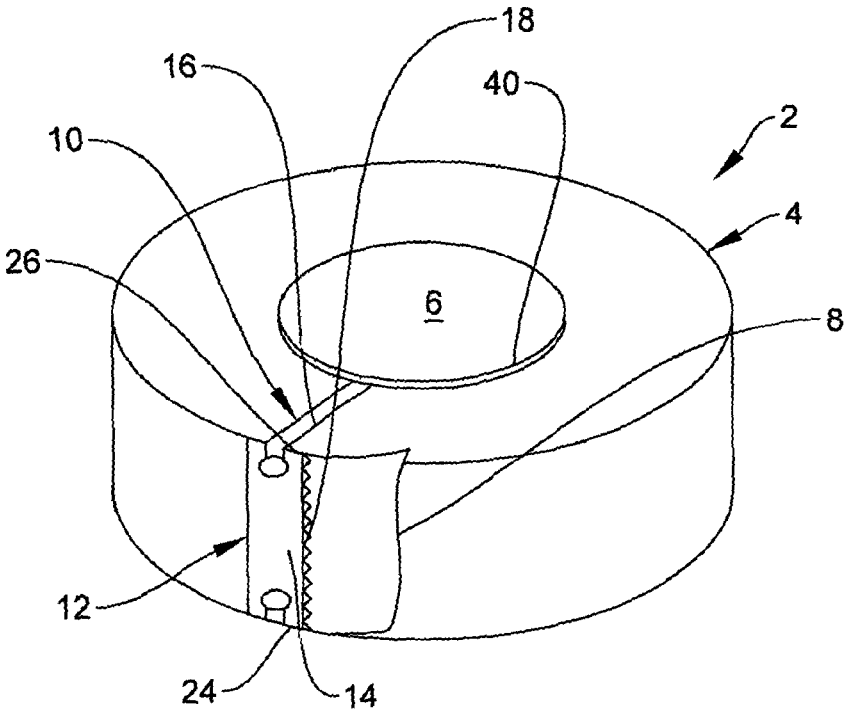
FIG. 1 is a perspective view of a first roll of dispensable sheet material.

In the accompanying drawings, FIGS. 1-12 and 17-26 are not of the present invention, and FIGS. 13-16 are of the present invention.

Referring to FIGS. 1-4, there is shown a roll 2 of dispensable sheet material 4. The roll 2 has an inner bore 6. The dispensable sheet material 4 is such that is has a free end 8 which is difficult to find for manual dispensation of the dispensable sheet material 4 from the roll 2.

Thus far described, the roll 2 of dispensable sheet material 4 may be any known roll 2 with the disposable sheet material 4 being in the form of adhesive tape.

The roll 2 is additionally provided with assist means 10 for assisting in the finding of the free end 8 of the dispensable sheet material 4. The assist means 10 comprises a band formation 12 which extends around the roll 2 by passing through the inner bore 6 and transversely over the width of the roll 2. The band formation 12 is movable around the roll 2 such that the band formation 12 is locatable on the roll 2 at a place to receive an end portion 14 of the dispensable sheet material 4 which contains the free end 8. The band formation 12 is thus able to indicate the position of the free end 8 and thereby facilitate the manual dispensation of the dispensable sheet material 4 from the roll 2.

The band formation 12 forms a low cost and an easy to use assist means for facilitating the manual dispensation of the dispensable sheet material 4 from the roll 2, and thereby avoiding or reducing user frustration in finding the free end 8 as would occur without the use of the band formation 12. As shown in FIG. 1, the band formation 12 has been placed such that the free end 8 extends circumferentially beyond the band formation 12 by a short amount. This ensures that the free end 8 does not become bent over and dirty. Alternatively, if desired, the band formation 12 may be placed such that the free end 8 terminates within the width of the band formation 12. The band formation 12 can be placed where desired by the user, providing that the placement of the band is always such that the user can easily find the free end 8.

Figure 2:
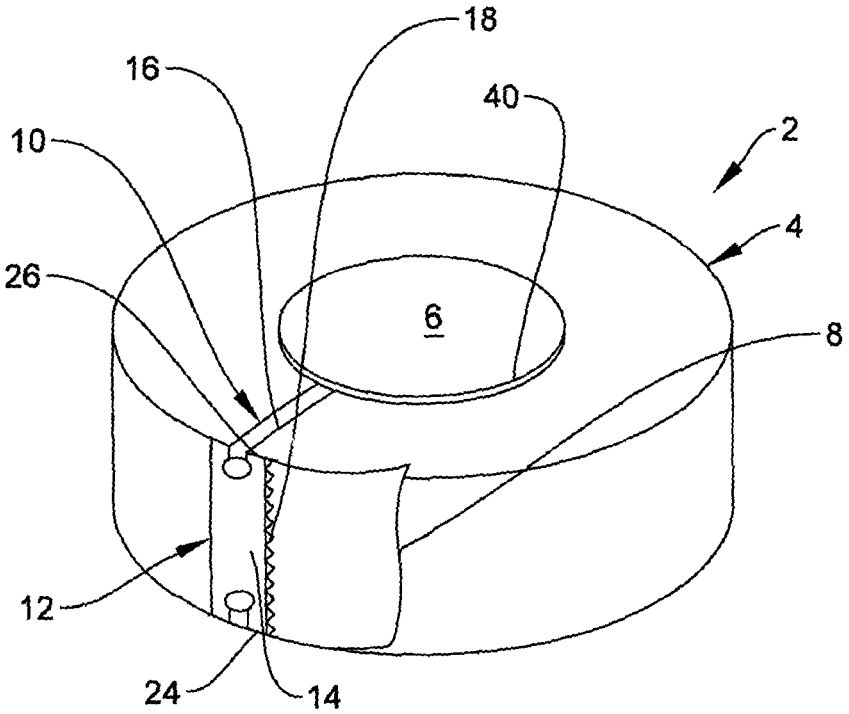
FIG. 2 is a perspective view like FIG. 1 and shows assist means having been moved from the position shown in FIG. 1 to the position shown in FIG. 2.

FIGS. 1 and 2 illustrate a preferred method of use of the roll 2. More specifically, as shown in FIG. 1, the band formation 12 is underneath the dispensable sheet material 4 when the roll 2 is not in use. When it is desired to obtain some of the dispensable sheet material 4 from the roll 2, the band formation 12 is moved from the position shown in FIG. 1 to the position shown in FIG. 2. As shown in FIG. 2, the band formation 12 is on top of the dispensable sheet material 4. In order to obtain the required length of the dispensable sheet material 4, the free end 8 of the dispensable sheet material 4 is pulled away from the roll 4. As the free end 8 is pulled, the band formation 12 is caused to move clockwise around the roll 2. When the desired length of the dispensable sheet material 4 has been pulled up, the free end 8 can then be moved over the top of the band formation 12 as shown in FIG. 2, whereupon the band formation 12 is able to cut the dispensable sheet material 4. After the cut length of the dispensable sheet material 4 has been used, the band formation 12 is then moved over the new free end 8. The band formation 12 is then slid underneath the free end 8 of the dispensable sheet material and to the position shown in FIG. 1. In the position shown in FIG. 1, the roll of tape 2 is ready for a next use, and the positioning of the band formation 12 underneath the free end 8 of the dispensable sheet material 4 ensures that the free end 8 is not lost and is easily found for the next use of the roll 2.

As shown in FIGS. 1-4, the band formation 12 comprises a first part 14 and a second part 16. As can best be appreciated from FIG. 4, the first and second parts 14, 16 are separately formed from each other.

The first part 14 is for use in identifying the free end of the dispensable sheet material as described above with reference to FIGS. 1 and 2. The second part 16 is connected to the first part 14. The second part 16 passes through the inner bore 6. The second part 16 secures the first part 14 on the roll 2.

Figure 3:
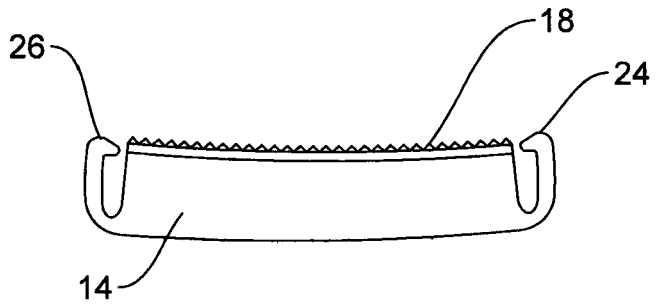
FIG. 3 shows part of the assist means shown in FIGS. 1 and 2.
Figure 4:
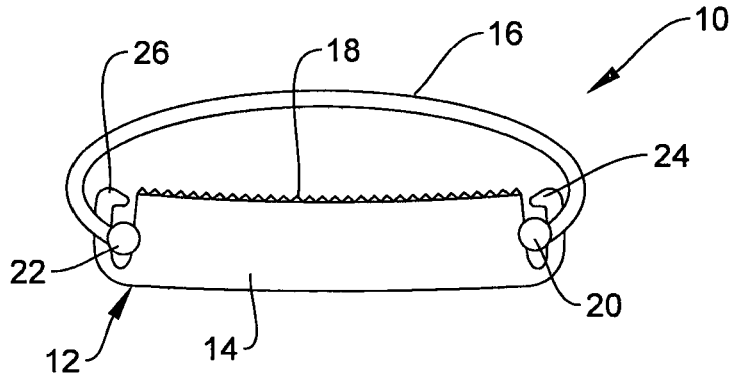
FIG. 4 shows the entire assist means shown in FIGS. 1 and 2.

As best seen from FIGS. 3 and 4, the first part 4 has cutter means 18 for cutting the dispensable sheet material 4 when the dispensable sheet material 4 is pulled against the cutter means 18.

The first part 14 is a strip. The strip may be made of a soft plastics material, rexine, leather, cardboard or any other suitable material. The second part 16 is an elastic second part 16. The elastic second part 16 is a strip having a first end 20 and a second end 22. The first and second ends 20, 22 are secured to first and second end formations 24, 26 respectively on the first part 14. As shown in FIG. 4, the first and second ends 20, 22 are formed as knots. The first and second ends 20, 22 could alternatively be other abutment means such for example as studs.

Figure 5:
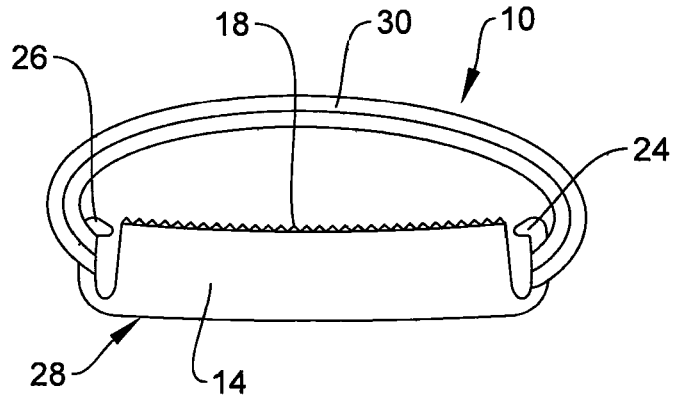
FIG. 5 is a view like FIG. 4 but shows alternative assist means.

FIG. 5 shows an alternative assist means 10 in the form of a band formation 28. Similar parts as in the band formation 12 have been given the same reference numerals for ease of comparison and understanding. It will be seen that the band formation 28 has the same first part 14 but a second part 30 which is not the same as the second part 16. More specifically, the second part 30 is a continuous elastic band which has been doubled back on itself and hooked around the first and second end formations 24, 26.

In FIG. 1-5, it will be seen that the cutter means 18 is in the form of a serrated knife blade edge. The cutter means 18 may alternatively be a straight knife blade edge.

Figure 6:
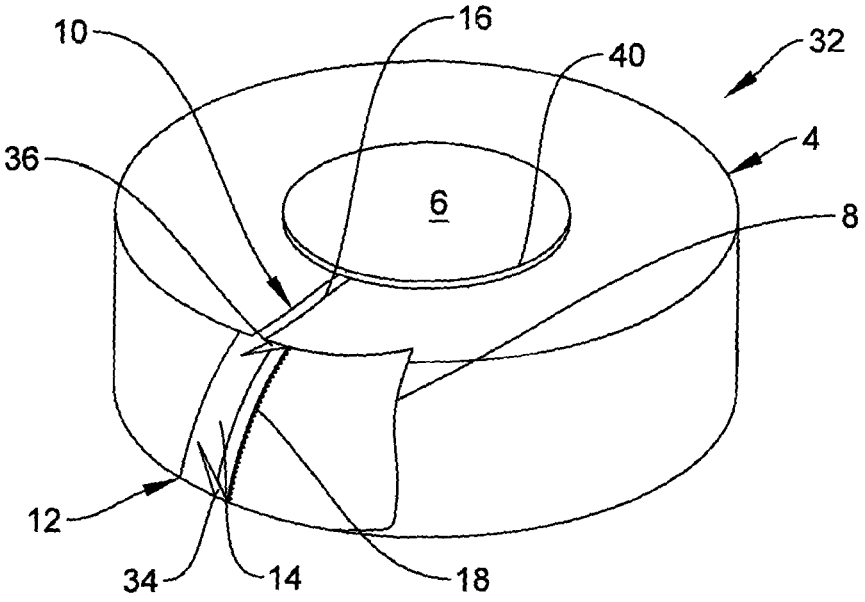
FIG. 6 is a perspective view of a second roll of dispensable sheet material.
Figure 7:
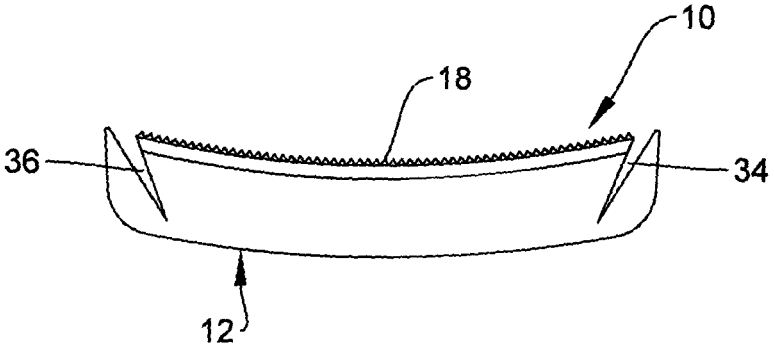
FIG. 7 shows part of the assist means shown in FIG. 6.

Referring now to FIGS. 6 and 7, there is shown a second roll 32 of dispensable sheet material. Similar parts as in the roll 2 have been given the same reference numerals for ease of comparison and understanding. It will be seen that in the roll 32, the first and second end formations 24, 26 have been replaced by first and second end formations 34, 36 respectively. These first and second end formations 34, 36 are in the form of inclined slots as can best be appreciated from FIG. 7.

Figure 8:
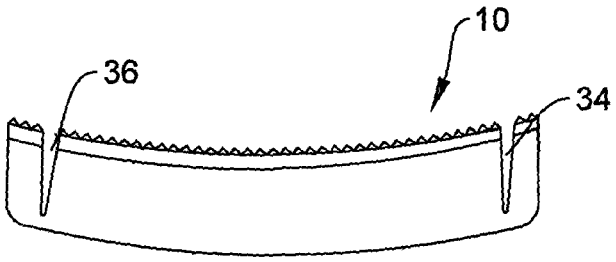
FIG. 8 is a view like FIG. 7 but shows alternative assist means to that shown in FIG. 7.

FIG. 8 shows an assist means 10 which is like the band formation 12 shown in FIGS. 6 and 7 except that the angle of the slots constituting the first and second end formations 34, 36 is steeper than in FIG. 7 as can be seen from a comparison of FIGS. 7 and 8.

Figure 9:
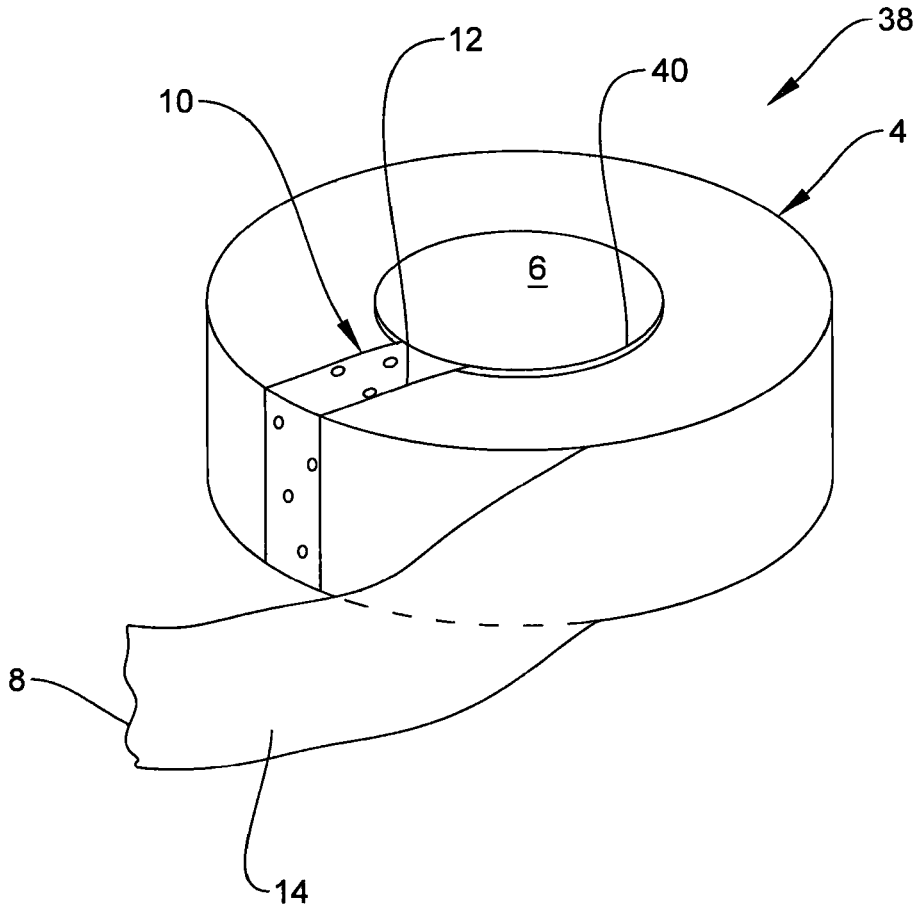
FIG. 9 is a perspective view of a third roll of dispensable sheet material.

Referring now to FIG. 9, there is shown a third roll 38 of dispensable sheet material. Similar parts as in previous Figures have been given the same reference numerals for ease of comparison and understanding. The roll 38 is such that the band formation is a continuous band 12. The continuous band formation 12 has no ends and it may be initially in the form of a strip which has been placed through the inner bore 6 and around the dispensable sheet material. The ends of the strip may then be secured together, for example by an adhesive or other securing means. The band formation 12 may be made of any suitable and appropriate material. Typically the material chosen will be such that the band formation 12 is easily able to be slid by a person around the circumference of the roll 2. The band formation 12 may be provided with a coating of a slide-facilitating material, for example Teflon (Registered Trade Mark).

As shown in FIGS. 1, 2, 6 and 9, the roll 2 is such that it includes a core 40 on which the dispensable sheet material 4 is wound. The core 40 is typically made of cardboard. The core 40 may be made of other materials if desired.

Figure 10:
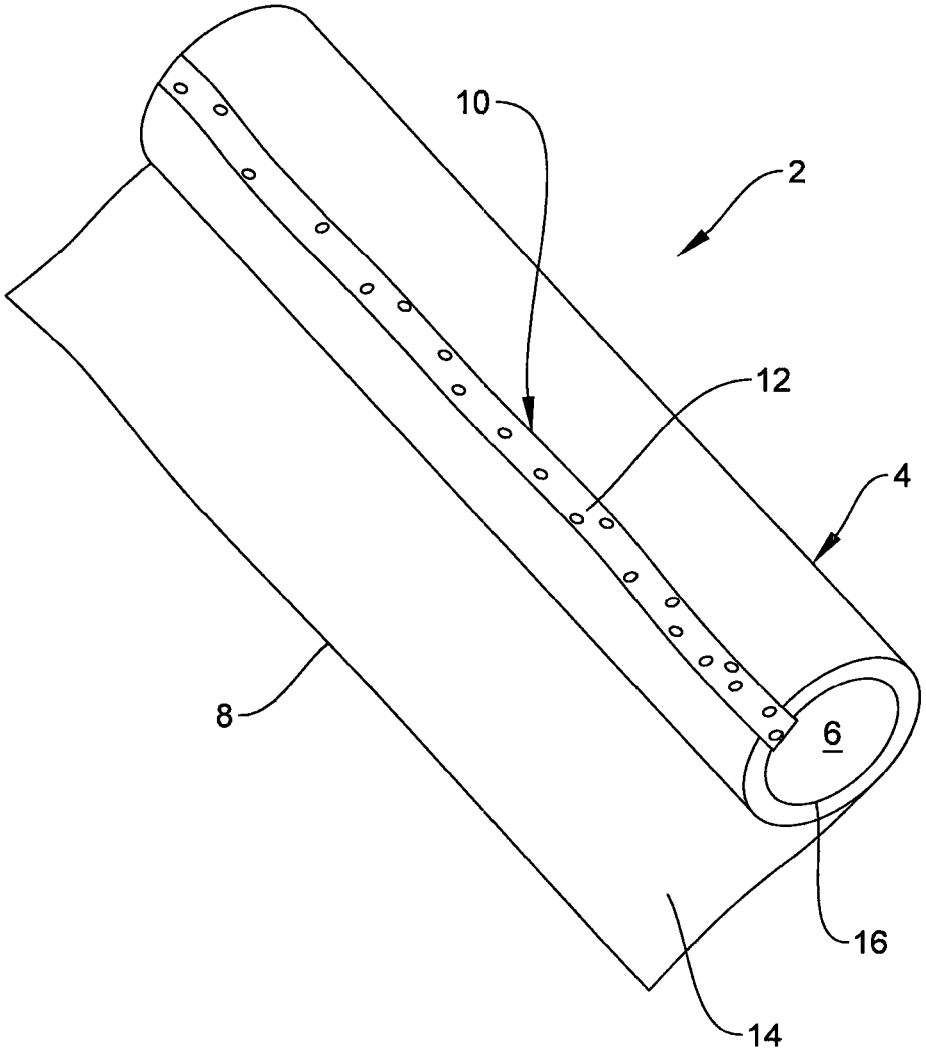
FIG. 10 is a perspective view of a fourth roll of dispensable sheet material of the present invention.
Figure 11:
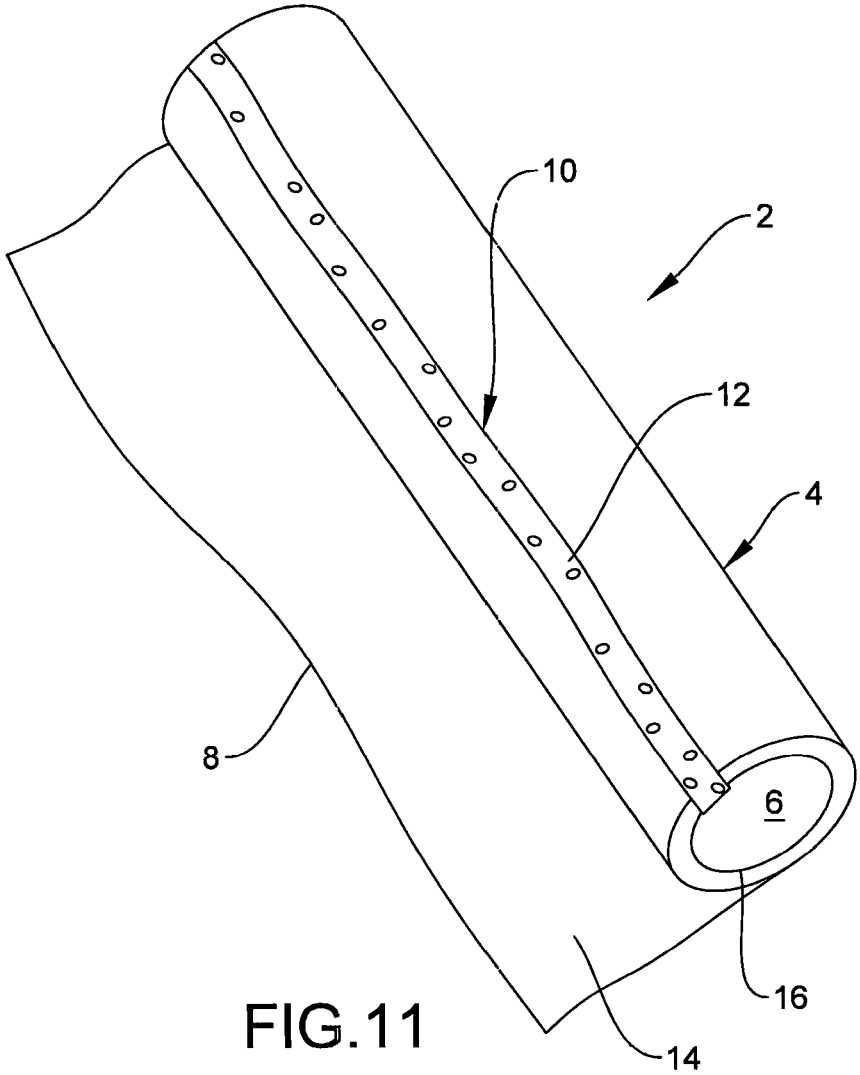
FIG. 11 is a perspective view of a fifth roll of dispensable sheet material.

Referring now to FIGS. 10 and 11, similar parts as in previous Figure have been given the same reference numerals for ease of comparison and understanding. In FIG. 10, the dispensable sheet material 4 is clingfilm. The band formation 12 in FIG. 10 is longer than the band formation 12 shown in FIGS. 1, 2, 6 and 9 but the band formation 12 still extends around the roll 2 by passing through the inner bore 6 and transversely over the width of the roll 2. In FIG. 11, the roll 2 is similar to the roll 2 shown in FIG. 10, except that in FIG. 11, the dispensable sheet material 4 is foil. The foil is aluminium foil. Other types of foil may be employed, including various types of metalised plastics foils.

Figure 12:
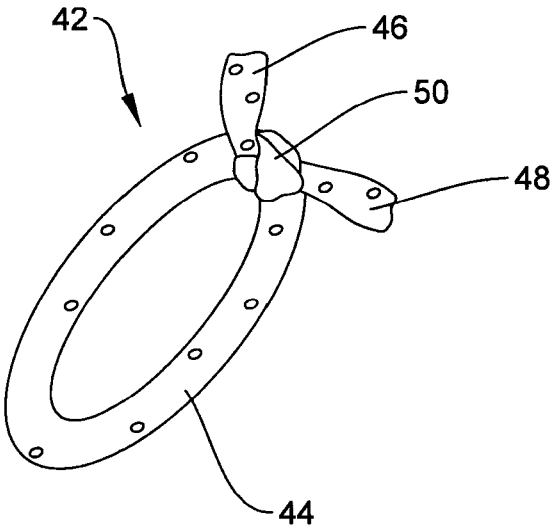
FIG. 12 shows a further alternative type of assist means for use with a roll of dispensable sheet material.

Referring now to FIG. 12, there is shown assist means 42 which is an alternative to the assist means 10. The assist means 42 comprises a band formation 44. The band formation 44 has a pair of ends 46, 48 which are tied together in a knot 50. The band formation 44 is thus a continuous band but one which has a grip formed by the ends 46, 48 and the knot 50. This grip is available for being gripped by a user in order to move the band formation 44 around the roll 2. The band formation 44 shown in FIG. 12 is an alternative to the band formation 12 shown in FIG. 9. The band formation 44 could be made longer if it were to be an alternative to the band formation 12 shown in FIG. 10 or the band formation 12 shown in FIG. 3.

Figure 13:
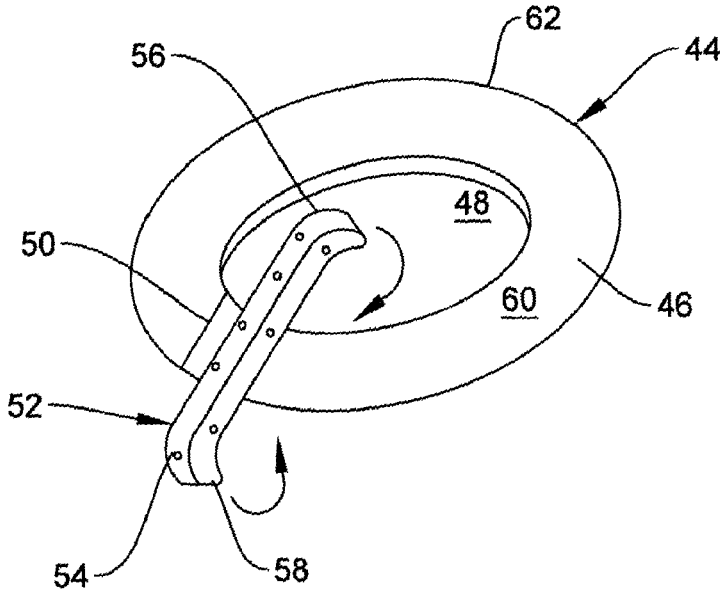
FIG. 13 is a perspective view of a sixth roll of dispensable sheet material and which is of the present invention.

Referring now to FIG. 13, there is shown a roll 44 of dispensable sheet material 46 according to the present invention. The roll 44 has an inner bore 48. The dispensable sheet material 46 has a free end 50. The roll 44 is provided with assist means 52. The assist means 52 comprises a device 54 which extends at least transversely over the width of the roll 44. More specifically, the device 54 extends over the width of the roll 44, and it has bent ends 56, 58 which extend along the inner and outer sides 60, 62 respectively of the roll 44 in order to hold the device 54 on the roll 44. In an alternative embodiment of the invention, the ends 60, 62 may be bent again to extend towards each other along the inside of the roll 44.

Figure 14:
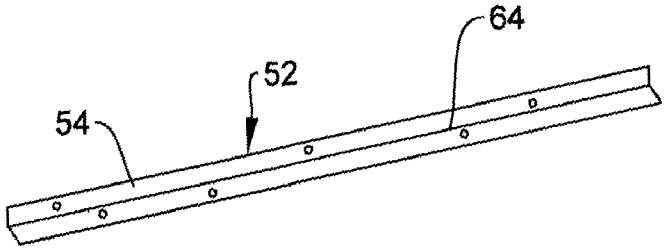
FIG. 14 shows the assist means used in FIG. 13.
Figure 15:
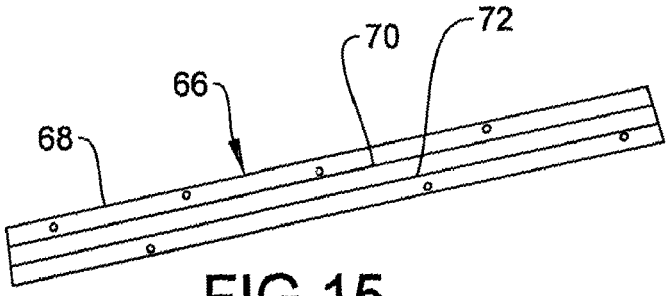
FIG. 15 shows a first alternative assist means to that shown in FIG. 14.
Figure 16:
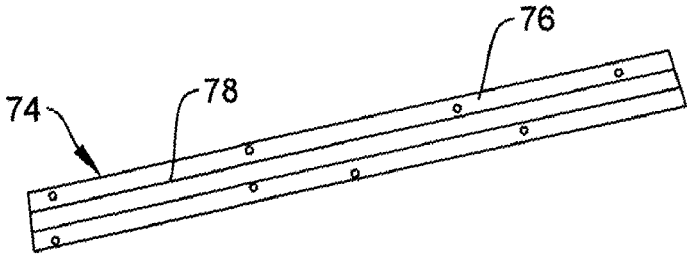
FIG. 16 shows a second alternative assist means to that shown in FIG. 14.

FIG. 14 shows how the device 54 is wire-reinforced with a single length of wire 64. FIG. 15 shows an alternative assist means 66 having a device 68 which is reinforced by two wires 70, 72. FIG. 16 shows assist means 74 having a device 76 which is reinforced by a flat-sided strip of wire 78. If the metal reinforcement is of a soft pliable metal, then the ends of the device can easily be bent to different increasing lengths to ensure that the assist means remains firmly on the roll as the roll gets thinner due to the dispensation of the sheet material from the roll.

Figure 17:
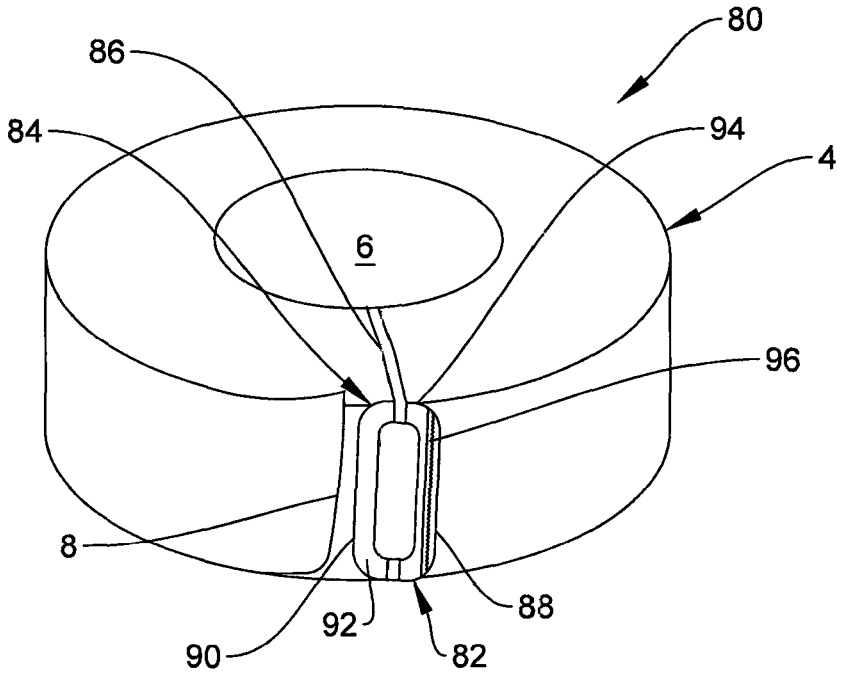
FIG. 17 is a perspective view of a sixth roll of dispensable sheet material.
Figure 18:
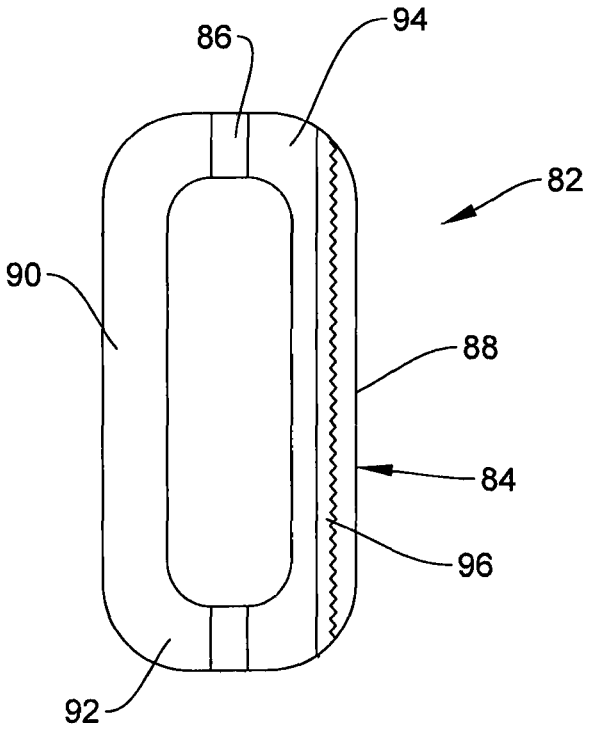
FIG. 18 is an enlarged view of the assist means shown in FIG. 17.

Referring now to FIGS. 17 and 18, there is shown a roll 80 of dispensable sheet material 4. The roll 80 has an inner bore 6. The dispensable sheet material 4 has a free end 8. As far described, similar parts as in previous Figures have been given the same reference numerals for ease of comparison and understanding.

The roll 80 has assist means 82 comprising a first part 84 and a second part 86.

The first part 84 is a four-sided structure having first and second sides 88, 90 which extend transversely over the width of the roll 80. The first part 84 also has third and fourth sides 92, 94 which extend along sides of the roll 2. Cutter means in the form of a serrated blade 96 is provided on the first side 88.

Figure 21:
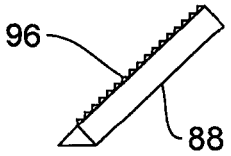
FIGS. 21, 22 and 23 show various cross sectional shapes for part of the assist means.
Figure 22:
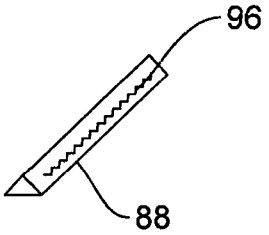
Figure 23:
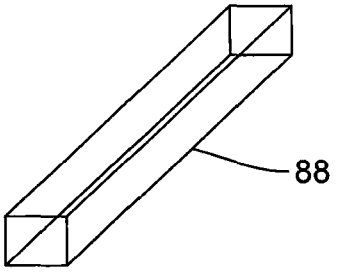

The first and second sides 88, 90 could be of the same or different cross sectional shapes. Triangular cross sectional shapes are shown in FIGS. 21 and 22. A rectangular cross sectional shape is shown in FIG. 23. The cross sectional shape could alternatively be a square cross sectional shape or any other desired cross sectional shape. FIG. 21 shows how the blade 96 is at the top of the first side 88. FIG. 22 shows how the blade 96 may alternatively be along one face of the side 88. The constructions shown in FIGS. 21, 22 and 23 can be used in any desired combination in the roll.

Figure 19:
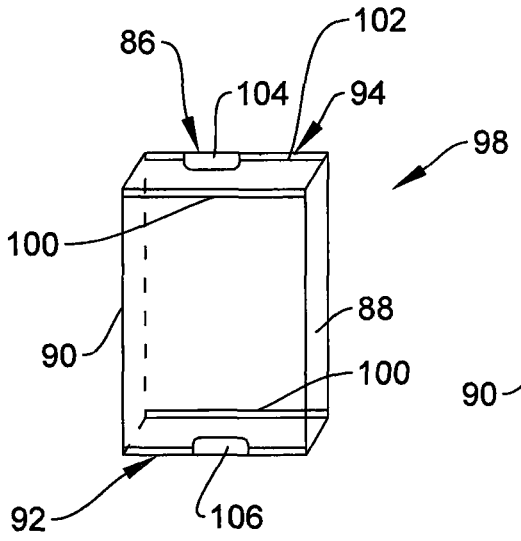
FIG. 19 is a perspective view of alternative assist means to that shown in FIG. 17.

FIG. 19 shows assist means 98. The assist means 98 is such that the third and fourth sides 92, 94 each comprises a pair of spaced apart arms 100, 102. One end 104 of the second part 86 is attached to the arm 102. The other end 106 is attached to the arm 100. The ends 104, 106 can be attached to different arms if desired. The second part 86 is an elasticated second part 86. The elasticated second part 86 may be a continuous band or simply an elasticated strip.

Figure 20:
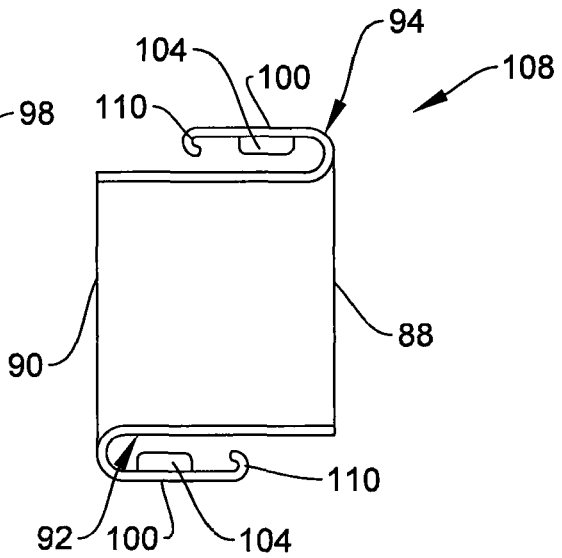
FIG. 20 is a perspective view of further alternative assist means to that shown in FIG. 17.

FIG. 20 shows alternative assist means 108 to the assist means 98 shown in FIG. 19. It will be seen that in the assist means 108, the arms 100, 102 have free ends which terminate in hooks 110.

In FIGS. 19 and 20, the blade 96 on the first side 88 has not been shown for simplicity of illustration. The blade 96 may be in various positions as mentioned above in connection with FIGS. 21, 22 and 23.

In all of FIGS. 17-20, the rolls 80, 98, 108 may be placed as desired in front of left or right handed users. Right handed users may typically orientate the roll of dispensable sheet material such that they pull the dispensable sheet material from the right. Left handed users may typically orientate the roll of dispensable sheet material such that they pull the dispensable sheet material from the left. In both instances, the blade 96 on the first side 88 is engaged for the purpose of cutting the dispensable sheet material to a required length. The second side 90 is then available for supporting the free end of the dispensable sheet material on the roll 4, so that this free end is easily identified and is able to be gripped for a next use of the roll 80, 98, 108.

Figure 24:
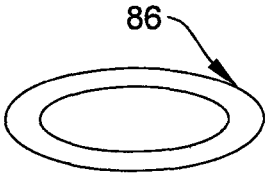
FIGS. 24, 25 and 26 show three different types of part of the assist means.
Figure 25:
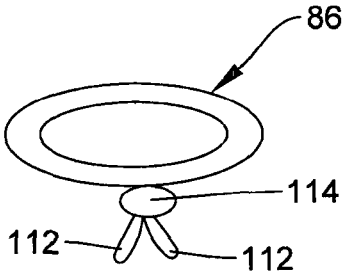
Figure 26:
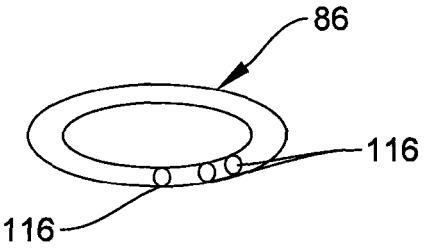

FIG. 24 shows a second part 86 in the form of a continuous flat stretchable band. FIG. 25 shows a second part 86 having ends 112 which are tied together with a knot 114. FIG. 26 shows a second part 86 having size adjusting means 116. The size adjusting means 116 are shown in the form of rings but alternative devices may be employed.

The first part 84 of the assist means 82 shown in FIGS. 17 and 18, and the first part of the alternative assist means shown in FIG. 19 and in FIG. 20 may be moulded from plastics materials. Other materials may be employed if desired. The second part 86 as shown in FIGS. 24, 25 and 26 may be made of any suitable materials. The second part 86 can be shortened or, lengthened as desired, for example by redoing the knot 114 in the second part 86 as shown in FIG. 25, or by looping the second part 86 shown in FIG. 24 more than one time prior to attaching it to the first part 84.

It is to be appreciated that the embodiments of the invention described above with reference to FIGS. 13-16 of the accompanying drawings have been given by way of example only and that modifications may be effected. Thus, for example, the dispensable sheet material 4 could be of a material other than single or double sided adhesive tape, clingfilm or foil. The shapes of the assist means shown in FIGS. 13-16 of the drawings may be varied. Individual components shown in the drawings are not limited to use in their drawings and they may be used in other drawings and in all aspects of the invention.

The invention claimed is:

1. A roll of dispensable sheet material, wherein the roll has an inner bore, the dispensable sheet material is such that it has a free end which is difficult to find for manual dispensation of the dispensable sheet material from the roll, the roll comprises assist means for assisting in the finding of the free end of the dispensable sheet material, the assist means comprises a device which extends at least transversely over the width of the roll, and the device is movable around the roll such that the device is locatable on the roll at a place to receive an end portion of the dispensable sheet material which contains the free end, whereby the device indicates the position of the free end and thereby facilitates the manual dispensation of the dispensable sheet material from the roll, and wherein the device is a strip of material which has bent ends for extending at least over sides of the roll in order to hold the device on the roll, and the strip of material is a wire-reinforced strip of material.

2. A roll of dispensable sheet material according to claim 1 in which the device includes a slide-facilitating material.

3. A roll of dispensable sheet material according to claim 1 and including a core on which the dispensable sheet material is wound.

4. A roll of dispensable sheet material according to claim 1 in which the dispensable sheet material is adhesive tape, clingfilm, a foil, or a double sided adhesive tape of the type used for rolling over clothes in order to remove dust, hair and fluff from the clothes.

* * * * *